US008286347B2

(12) United States Patent
Dupeux et al.

(10) Patent No.: US 8,286,347 B2
(45) Date of Patent: Oct. 16, 2012

(54) METHOD FOR REDUCING VIBRATION LEVELS OF A BLADED WHEEL IN A TURBOMACHINE

(75) Inventors: Jerome Alain Dupeux, Vaux le Penil (FR); Jean-Pierre Francois Lombard, Pamfou (FR); Virendra Sharma, Paris (FR); Samy Mitha, Ste Genevieve des Bois (FR)

(73) Assignee: SNECMA, Paris (FR)

( * ) Notice: Subject to any disclaimer, the term of this patent is extended or adjusted under 35 U.S.C. 154(b) by 1237 days.

(21) Appl. No.: 12/035,966

(22) Filed: Feb. 22, 2008

(65) Prior Publication Data

US 2008/0206058 A1 Aug. 28, 2008

(30) Foreign Application Priority Data

Feb. 27, 2007 (FR) ..... 07 01408

(51) Int. Cl.
*B21K 25/00* (2006.01)
*B23P 15/04* (2006.01)

(52) U.S. Cl. ..... 29/889.21; 29/889; 29/889.2; 29/889.3

(58) Field of Classification Search ..... 29/889, 29/889.2, 889.21, 889.3
See application file for complete search history.

(56) References Cited

U.S. PATENT DOCUMENTS 6,530,542 B2 * 3/2003 Toulmay ..... 244/17.13
7,191,161 B1 * 3/2007 Rai et al. ..... 706/15
7,296,977 B2 * 11/2007 Bonnet ..... 416/230

FOREIGN PATENT DOCUMENTS

EP 1 528 223 A2 5/2005
EP 1 589 191 A1 10/2005
FR 2 824 597 A1 11/2002
WO WO 95/29331 11/1995
WO WO 98/36966 8/1998

OTHER PUBLICATIONS

U.S. Appl. No. 12/548,040, filed Aug. 26, 2009, Lombard, et al.
U.S. Appl. No. 12/548,008, filed Aug. 26, 2009, Lombard, et al.

* cited by examiner

*Primary Examiner* — Richard Chang
(74) *Attorney, Agent, or Firm* — Oblon, Spivak, McClelland, Maier & Neustadt, L.L.P.

(57) ABSTRACT

A method for reducing vibration levels in a turbomachine including at least a first and a second bladed wheel, due to aerodynamic perturbations that are produced by the second bladed wheel or an obstacle on the first bladed wheel is disclosed. The method includes: defining an initial configuration of the blades; calculating the synchronous forced response on the first bladed wheel as a function of the harmonic excitation force produced by the second bladed wheel expressed in the form of a linear function of the generalized aerodynamic force for the mode considered; determining a geometric tangential shift value θ for the stacked cross sections of one of the two wheels to reduce the corresponding term to the generalized aerodynamic force. The set of cross sections with the tangential shifts thus defines a new configuration of the blades of one of the two wheels.

7 Claims, 3 Drawing Sheets

METHOD FOR REDUCING VIBRATION LEVELS OF A BLADED WHEEL IN A TURBOMACHINE

The present invention concerns the field of turbomachines and aims at a method for reducing the vibrations on the blades of a bladed wheel subject to a periodic excitation resulting from perturbations in the gas flow passing through the turbomachine, as produced by a bladed wheel or an obstacle close to said wheel, one wheel generally moving and the other being stationary.

BACKGROUND OF THE INVENTION

A turbomachine comprises one or more rotors formed of bladed wheels, that is to say of blades mounted on a moving disk rotating about an axis, and one or more cascades formed of bladed wheels that are stationary, that is to say not moving in rotation with respect to the above axis. The blades of the stationary and moving wheels over which a gaseous fluid passes in a direction generally parallel to the axis. One of the principal sources of excitation of the stationary or moving blades is due to the wakes and the pressure fluctuations generated by obstacles adjacent the blading. These various obstacles, namely the blades of stages upstream and downstream, or even the arms of the casing, lead to perturbations in the flow of fluid through the blading. Movement of the blades in these perturbations creates a harmonic excitation synchronous with the rotor's rotation speed and generates an unsteady pressure field on the surface of the blade.

In the field of aeronautical turbomachines, the bladings are particularly sensitive parts because their design must meet the requirements of aerodynamic performance, of aeroacoustics and of mechanical resistance to rotation, to the temperature and to aerodynamic load. These aspects together mean that these structures are under quite a high static load and that, taking account of lifetime requirements, the amplitudes of vibrations they are subjected to must remain low. Moreover, the aeroelastic coupling, that is the coupling between the dynamics of the bladed wheels and the fluid flow, determines the vibration stability of the structure.

Within the context of the design of a turbomachine, and taking account of the multidisciplinarity of the contributors, the design process is iterative. The vibration design work is carried out to avoid the presence of critical resonances in the machine's operational range. The assembly is validated at the end of the design cycle using a test engine on which the vibration amplitudes are measured. Sometimes there are high vibration levels linked either to resonances or to vibrational instabilities. The rotor concerned must then be readjusted, which is particularly time-consuming and expensive.

SUMMARY OF THE INVENTION

The objective of the present invention is to control, already during the machine's design or development phase, the vibration response levels of the bladed wheels in a turbomachine structure comprising at least one moving bladed wheel and one stationary bladed wheel over which a gas flow passes.

The invention thus aims to deal with the vibrations produced by perturbations generated, for example, by one of the wheels in the gas flow on the other bladed wheel. In one particular case it targets the perturbations in the gas flow generated by the wake of a stationary bladed wheel or of an obstacle such as casing arms. These perturbations produce vibrations on the moving bladed wheel situated downstream.

The objective of the present invention is not limited to the control of vibration levels in a configuration where the bladed wheels are adjacent; it aims to control vibration responses on a bladed wheel for perturbations whose origin is upstream or downstream of the bladed wheel without being limited to the adjacent wheels.

The invention also targets excitations of the type distorting the aerodynamic flow path due to one or more bleeds in the gas stream or to distortion of the engine air inlet duct, when the engine is a turbojet, in the case of crosswind or incident wind. In the following, these distortions are included under the term "obstacle".

Another objective of the invention is to implement a method allowing corrective measures to be taken as early or as far upstream as possible in the process of designing and adjusting the bladed wheels of turbomachines.

More particularly its objective is to reduce the vibration levels synchronous with the rotor's rotation speed on a moving or stationary bladed wheel, generated by the relative movement of the wakes or of the distortion resulting from a bladed wheel that is adjacent or at one or two stages remove upstream or downstream.

In accordance with the invention, the method for reducing vibration levels likely to occur in a turbomachine comprising at least a first bladed wheel and a second bladed wheel, where the two wheels are moving relative to one another about an axis of rotation and a gaseous fluid is passing over them, due to perturbations of an aerodynamic origin that are produced by the second bladed wheel or an obstacle on the first bladed wheel, is characterized in that the following steps are included in the design of said two bladed wheels:

A—an initial configuration of the blades is defined as a function of the expected performance of the turbomachine using the individual aerodynamic profiles of p cross sections radially stacked between the root and the tip of said blades;

B—the synchronous forced response $y(\omega)$ on the first bladed wheel is calculated as a function of the harmonic excitation force $f(\omega)$ produced by the second bladed wheel or the obstacle from the relation $y(\omega)=F({}^{\tau}y_{\nu}f(\omega))$, where F is a linear function of the generalized aerodynamic force ${}^{\tau}y_{\nu}f(\omega)$ for the eigenmode $\nu$ considered;

C—a coefficient ($\alpha<1$) for the reduction in the synchronous forced response $y(\omega)$ is defined;

D—a geometric tangential shift value $\theta$ for the stacking axis is determined for each of said p stacked cross sections of one of the two wheels so as to reduce the term corresponding to the generalized aerodynamic force $|{}^{\tau}yf(\omega)|$, the temporal phase shift $\phi$ of the excitation pressure $f(\omega)$ being linked to the geometric tangential shift by the relation $\theta=N_{excit}\phi$, where $N_{excit}$ is the number of excitation sources; the set of p cross sections with the tangential shifts thus defines a new configuration of the blades of said one of the two wheels;

E—the synchronous forced response $y'(\omega)$ on the first bladed wheel is calculated;

F—if $|y'(\omega)|>\alpha|y(\omega)|$ the calculation in D is repeated with new geometric tangential shift values to be applied to the stacking axis; and G—if $|y'(\omega)|<\alpha|y(\omega)|$ the new configuration is applied to at least some, and more particularly to all, of the blades of said one of the two wheels.

Modification of the initial configuration preferably starts with the stationary wheel, whether this is the exciting bladed wheel or the wheel being subjected to the excitation.

More particularly, the invention allows various cases to be dealt with:

- The first wheel is a moving bladed wheel and the second bladed wheel is a stationary wheel, the moving bladed wheel being in the wake of the stationary bladed wheel.
- The first bladed wheel is a moving wheel and the second bladed wheel is a stationary wheel, the moving wheel being upstream of the stationary wheel.
- The first bladed wheel is a stationary wheel and the second bladed wheel is a moving wheel, the stationary wheel being in the wake of the moving wheel.
- The first bladed wheel is a stationary wheel and the second bladed wheel is a moving wheel, the stationary wheel being upstream of the moving wheel.

The invention results from the theoretical analysis of vibration phenomena. Assuming a unit norm for the eigenvectors with respect to the mass, it is shown that the forced response $y(\omega)$ of a linear structure subject to a harmonic excitation force $f(\omega)$ is linked to the latter by a relation that can be formulated using complex terms in the manner expressed below:

$$y(\omega) = F({}^{\tau}y_{\nu}f(\omega)) = \sum_{\nu=1}^{n} [y_{\nu}^{T} y_{\nu} 1 / (\omega_{\nu}^{2} - \omega^{2} + j\omega\beta_{\nu})] f(\omega) \quad (1)$$

where:

the sign $\Sigma$ means that the forced response $y(\omega)$ is the sum of the forced responses of each of the eigenmodes $\nu$ at the angular frequency $\omega$. The forced response for a determined eigenmode is given by the relation in brackets. The sum takes account of all the n eigenmodes $\nu$ taken into consideration and which it is necessary to deal with, that is from the eigenmode $\nu=1$ through to the eigenmode $\nu=n$;

$y_{\nu}$ corresponds to the mode shape of the mode $\nu$ on the assumption of a unit norm for the eigenvectors with respect to the mass;

${}^{T}y_{\nu}$ corresponds to the transpose of the preceding vector;

$\omega_{\nu}$ corresponds to the angular frequency of the eigenmode $\nu$;

$\omega$ corresponds to the angular frequency of the excitation;

$$j^2=-1;$$

$\beta_{\nu}$ corresponds to the generalized modal damping for the eigenmode $\nu$; and $f(\omega)$ is the harmonic excitation force, itself being of the form $f\cos(\omega t+\phi)$ with time t and temporal phase shift $\phi$.

In the case of an excitation of aerodynamic origin applied to a bladed wheel, the term ${}^{\tau}y_{\nu}f(\omega)$ represents the generalized aerodynamic force for the eigenmode $\nu$.

Within the context of the invention, dealing with vibration phenomena comprises the implemention of means for reducing the modulus $|y(\omega)|$.

Whereas to minimize the modulus $|y(\omega)|$ of the forced response subject to the excitation force $f(\omega)$ it is usual to seek to increase the factor $\beta_{\nu}$ linked with the damping for the eigenmode $\nu$, in accordance with the present invention effort has been concentrated on reducing the modulus by a term corresponding to the generalized aerodynamic force of each of the eigenmodes $\nu$.

A procedure for achieving this consists in modifying the stacking axis of the blades studied in the direction tangential to the axis of rotation. The profile of the airfoil of a blade is geometrically defined from the profiles of each of the mutually parallel cross sections made between the root of the blade and its tip. The cross sections thus form a stack along a curve which is designated the stacking axis. The profiles are aeromechanically determined.

The starting assumption was that for a determined cross section a modification in the tangential direction leaves the unsteady pressure modules unchanged for small variations (for example, of the order of one degree for a wheel made up of 150 sectors, cf. FIG. 10).

This allows the temporal phase $\phi$ of the pressures to be linked directly to the tangential distance $\theta$ relative to the stacking axis through a cross section of the blade. The equivalence between the temporal phase shift on the pressures and the geometric phase shift, that is the tangential displacement to be applied to the blade, is established with the following relation:

$$\phi=\theta N_{excit}$$

where $\phi$=temporal phase shift $\theta$=geometric phase shift $N_{excit}$=number of exciting blades.

BRIEF DESCRIPTION OF THE DRAWINGS

The procedure according to the invention is described further in detail below with reference to the figures in which.

DESCRIPTION OF THE PREFERRED EMBODIMENTS

Figure 1:
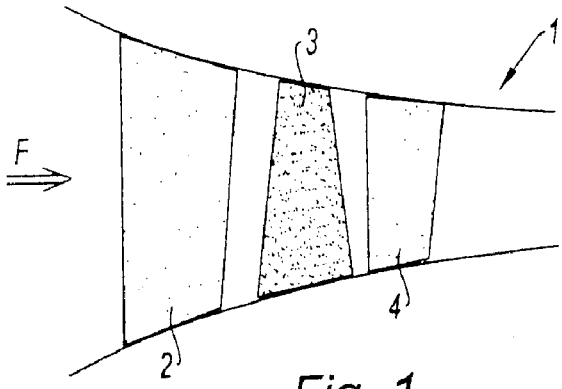
FIG. 1 schematically represents a turbomachine structure.

As can be seen in FIG. 1, a turbomachine structure 1, here a compressor, comprises at least one bladed wheel 3 moving about an axis of rotation and adjacent at least one stationary bladed wheel 2 or 4. In general the structure comprises a number of moving wheels separated by stationary wheels.

Figure 2:
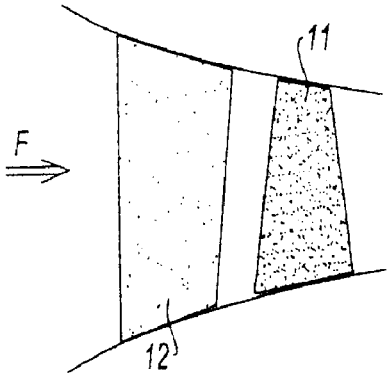
FIGS. 2 to 5 show different cases it is possible to deal with in accordance with the invention.

As mentioned above, movement of one wheel relative to the other within an axial gas flow, represented by the arrow F, is a source of perturbations. For example, with reference to FIG. 2, a first moving wheel 11 is subject to the influence of a second stationary bladed wheel 12 by being in its wake. This wake is the source of perturbations on the first moving wheel 11.

Figure 3:
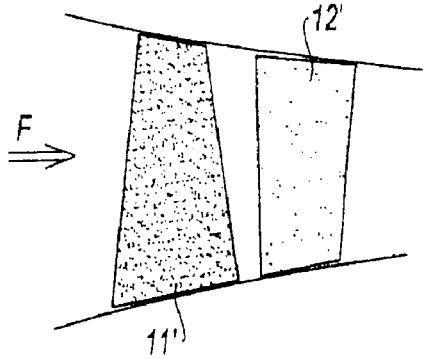

Other cases are possible in the context of the invention. In FIG. 3 a first, moving bladed wheel 11' is considered in its position upstream of a second, stationary bladed wheel 12' and which is subject to the excitation forces generated by this second wheel 12' downstream.

Figure 4:
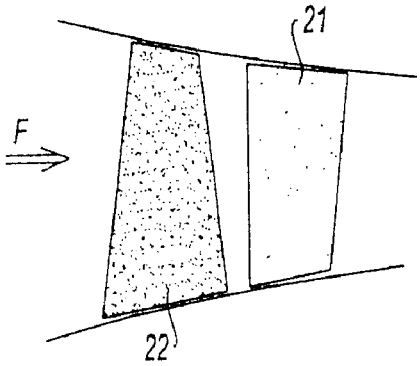

In the case of FIG. 4, the perturbations on a first, stationary bladed wheel 21 generated by the gas flow passing over a moving bladed wheel 22 upstream are considered.

Figure 5:
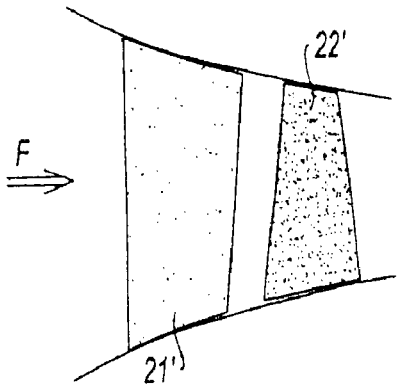

In the case of FIG. 5, the perturbations on a first, stationary wheel 21' generated by the gas flow passing over a second, moving bladed wheel 22' downstream are considered.

Other cases are targeted by the present invention, but this is not limited to adjacent wheels.

Figure 6:
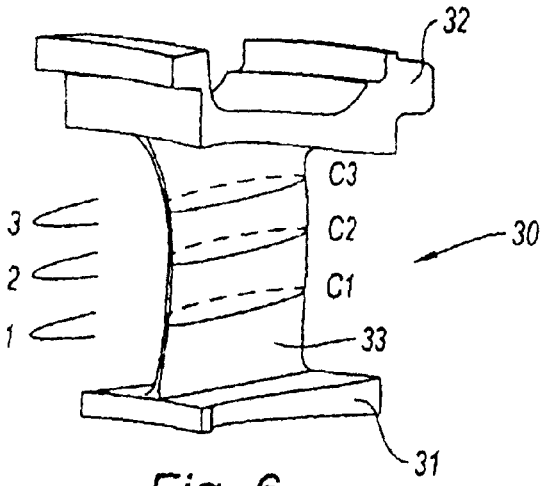
FIG. 6 shows a blade of a stationary bladed wheel in the initial configuration.

The profile of a blade, and of its airfoil in particular, is generally determined by a number of cross sections carried out in the radial direction between the root and the tip. FIG. 6 shows a stationary blade 30 of a fixed stage of a turbomachine with a root 31 and its platform, a tip 32 and its platform, and between the two an airfoil 33 swept by the gas flow. In position in the turbomachine the airfoil 33 is oriented radially in relation to the axis of the turbomachine. The airfoil is defined geometrically by the individual profiles of a number of cross sections $c_1, c_2, c_3, \ldots c_p$ (p being of the order of 20) through the planes p1, p2, . . . $p_p$ at a tangent to this radial direction. For a moving wheel the profile of the airfoil swept by the gas flow is defined in the same way using cross sections made through the tangent planes.

In accordance with the invention the modulus of the forced response $y(\omega)$ of the blades of a first bladed wheel is reduced by searching for a distribution of pressure components suitable to minimize the modulus of the generalized aerodynamic force associated with each of the eigenmodes $\nu$.

In fact, as results from the abovementioned formula (1), the generalized aerodynamic force associated with an eigenmode is a multiplying factor that appears in each of the terms of the sum $\Sigma$.

It is to be noted that the excited blade is not necessarily modified. It suffices to act on one of the blades, either forming the excitation source or being excited by the excitation source.

Figure 7:
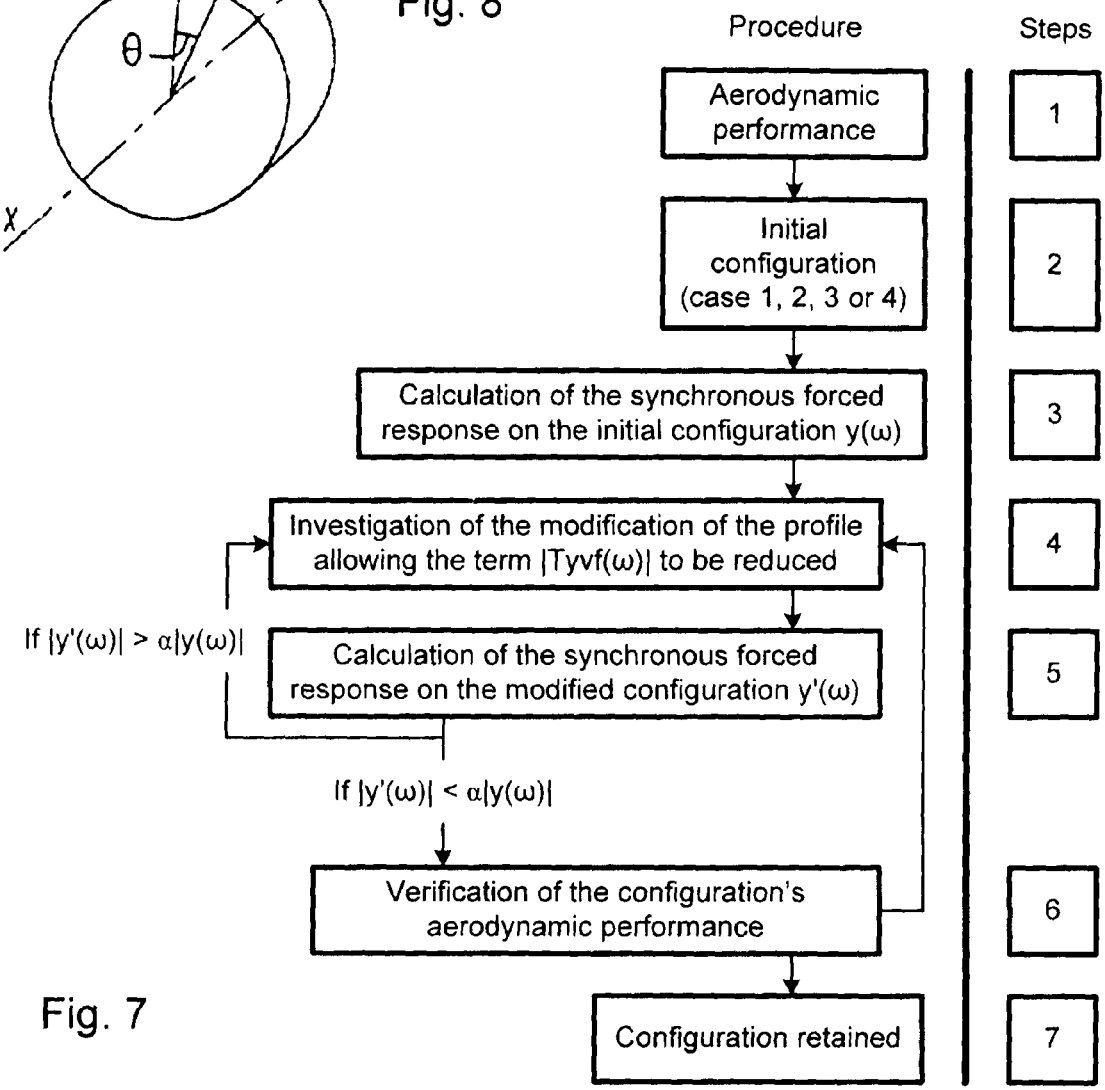
FIG. 7 is a flowchart of the different steps of the method according to the invention.

The procedure is elaborated below in relation to the flowchart of FIG. 7.

The first two steps consist in defining the specifications in terms of the aerodynamic performance of the structure comprising two bladed wheels, then of calculating the initial configuration of the bladed wheels. This configuration includes the profiles of the cross sections $c_1, \ldots c_p$ and their stacking. Generally the procedure performs aerodynamic iterations, as is known to the person skilled in the art.

Step 3: The forced aeroelastic response $y(\omega)$ on the blading in the initial configuration is calculated when excited by a synchronous aerodynamic excitation $f(\omega)$:

- The excitation is determined with the help of an unstable aerodynamic calculation;
- a calculation of forced aeroelastic response (defined by the relation (1)) is then carried out to determine the vibration levels;
- the criticality of these vibration levels is determined with the help of a Haigh diagram. For a given static stress, this diagram defined for a given material makes it possible to define the admissible dynamic stress for having an infinite lifetime while vibrating.

If the vibration levels predicted (or measured in a test) are large in relation to experience, a target $\alpha|y(\omega)|$ (with $0<\alpha<1$) in terms of the maximum vibration level is defined.

This must be done such that the value of $\alpha$ is as low as possible, taking account of manufacturing tolerances.

Step 4: The procedure according to the invention is applied with the above maximum vibration level as target.

The modulus of the forced aeroelastic response is minimized for a given mode, knowing that it could be extended to any mode.

Figure 8:
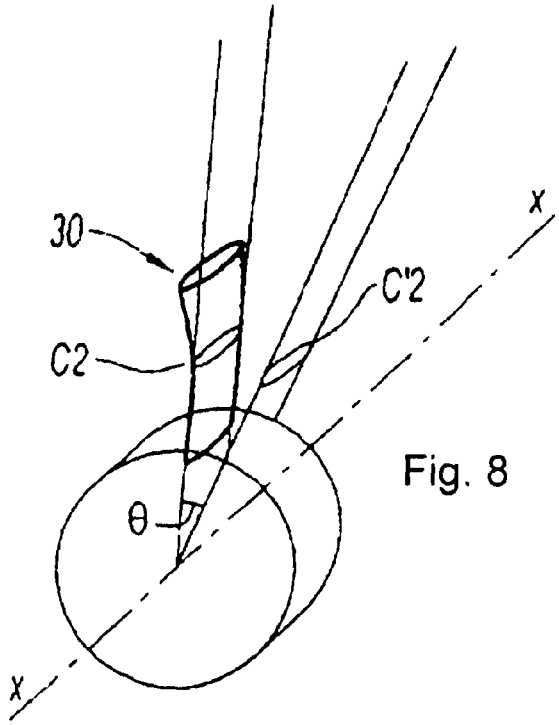
FIG. 8 shows the definition of the angle $\theta$ of tangential shift of a cross section defined in relation to the axis of rotation.

The method consists in determining the geometric shift $\theta$, illustrated in FIG. 8, applied to the tangential stacking axis in such a way as to minimize the vibration response due to the perturbation, such as the wake. Tangential shift parameters are adopted for application to the blade profile to be modified. In FIG. 8 the airfoil 30 of FIG. 6 has been taken again, and the calculation carried out on the cross section c2. The value of $\theta$ that leads the cross section in c'2 to shift angularly is determined.

To do this, spline/pole techniques, or techniques based on any discrete form or one chosen to project the stacking law are used for example.

Any optimization method may be used. By way of example, we cite some conventional methods: gradient method, the method called "simulated annealing", genetic method, etc. (The quantity to be minimized is the modulus $|{}^{T}y_{\nu}f(\omega)|$ or the sum of the moduli in the case of multimodal optimization.)

Step 5: Calculation of the forced aeroelastic response $y'(\omega)$ on the modified blading is carried out to verify that the target in terms of maximum vibration level has indeed been attained. If this is not the case a new definition of the profile is defined.

Step 6: Once the target is attained, it is verified that aerodynamic performance has been maintained by modifying the stacking axis of the blade concerned.

Step 7: The new definition of the blading is retained. It satisfies the aerodynamic criteria in terms of performance and the mechanical criteria in terms of vibration levels.

Figure 9:
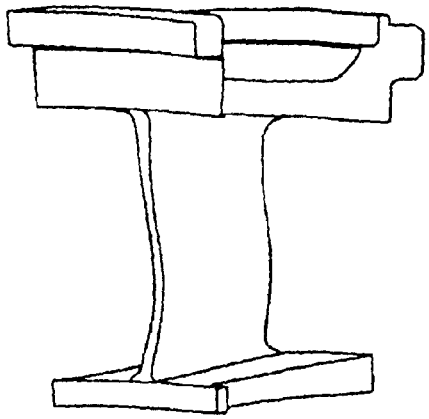
FIG. 9 shows a blade of a stationary bladed wheel the configuration of which has been modified in accordance with the invention to reduce vibration levels.

FIG. 9 shows an example of the appearance assumed by the blade 30 of FIG. 6 after the method of the invention has been applied. The cross sections c1, c2, etc. are not modified aerodynamically. Each of them has been subjected to a tangential shift about the axis of the turbomachine.

Figure 10:
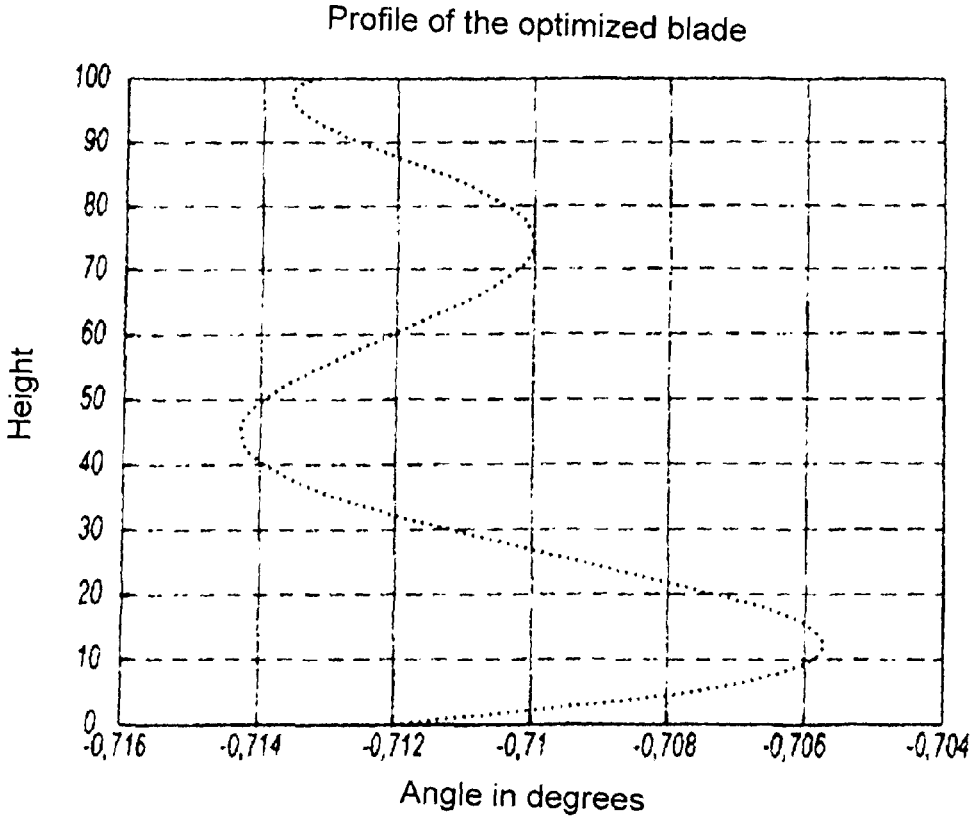
FIG. 10 is a graph illustrating an example of a blade profile for values of the tangential shift angle.

FIG. 10 shows a graph of an example of the profile of an optimized blade. Each point represents the value of the angle $\theta$ for each of the cross sections $c_1$ to $c_p$ over the whole height of the blade's airfoil. Note that this value remains relatively low, according to this example less than 1 degree in relation to the corresponding position in the initial configuration.

To the extent that the correction values are greater than the manufacturing tolerances for the blades, one has a means of reducing the vibration levels without adding mass or at the same time modifying aerodynamic performance of the turbomachine and of the technological interfaces of the blading.

The levels generated by wakes are reduced: namely, the wake of the stator/distributor or the wake of the moving bladed wheel. As specified above, the levels generated by distortions of the aerodynamic flow path, generated by one or more bleeds in the gas stream or by distortion of the engine's air inlet duct, are reduced. Other types of excitation are not taken into account. Although it addresses stator/distributor wheels and moving wheels, it is preferred to act on the excitation source which is a bladed stator/distributor wheel.

What is claimed is:

1. A method for reducing vibration levels in a turbomachine comprising at least a first bladed wheel and a second bladed wheel, where the first and second wheels are moving relative to one another about an axis of rotation and a gaseous fluid is passing over the first and second wheels, due to perturbations of an aerodynamic origin that are produced by the second bladed wheel or an obstacle on the first bladed wheel, the method comprising:

A—defining an initial configuration of the blades as a function of an expected performance of the turbomachine using individual aerodynamic profiles of p cross sections radially stacked between a root and a tip of said blades;

B—calculating, using a computer, a synchronous forced response $y(\omega)$ on the first bladed wheel as a function of a harmonic excitation force $f(\omega)$ produced by the second bladed wheel or the obstacle from a relation $y(\omega)=F({}^{T}y_{\nu}f$ (ω)), where F is a linear function of a generalized aerodynamic force ${}^{\tau}y_{\nu}f(\omega)$ for an eigenmode ν considered;

C—defining a coefficient ($\alpha<1$) for the reduction in a synchronous forced response y(ω);

D—determining, using the computer, a geometric tangential shift value θ for each of said p stacked cross sections of one of the two wheels so as to reduce a term corresponding to the generalized aerodynamic force associated with the eigenmode ν, $|{}^{\tau}yf(\omega)|$, a temporal phase shift ϕ of the excitation force f(ω) being linked to a geometric tangential shift by a relation $\theta=N_{excit}\phi$, where $N_{excit}$ is a number of excitation sources; defining a new configuration of the blades of said one of the first and second wheels as a set of p cross sections with the tangential shifts;

E—calculating, using the computer, a synchronous forced response y'(ω) on the first bladed wheel;

F—repeating the calculation in D with new geometric tangential shift values if $|y'(\omega)|>\alpha|y(\omega)|$; and G—manufacturing at least some of the blades of said one of the first and second wheels with the new configuration if $|y'(\omega)|<\alpha|y(\omega)|$.

2. The method as claimed in claim 1, wherein:

$$y(\omega) = F({}^{\tau}y_{\nu}f(\omega)) = \sum_{\nu=1}^{n} [y_{\nu}^{T} y_{\nu} 1 / (\omega_{\nu}^{2} - \omega^{2} + j\omega\beta_{\nu})] f(\omega) \tag{1}$$

where:

the sign Σ means that the forced response y(ω) is a sum of the forced responses of each of the eigenmodes ν at angular frequency ω;

$y_{\nu}$ corresponds to a mode shape of the mode ν on an assumption of a unit norm for eigenvectors with respect to mass;

${}^{T}y_{y\nu}$ corresponds to a transpose of a preceding vector;

$\omega_{\nu}$ corresponds to angular frequency associated with the mode ν;

ω corresponds to angular frequency of excitation;

$j^2=-1$;

$\beta_{\nu}$ corresponds to generalized modal damping for the mode ν; and f(ω) is the harmonic excitation force, of form $f\cos(\omega t+\phi)$ with time t and temporal phase shift ϕ.

3. The method as claimed in claim 1 or 2, wherein said one of the first and second wheels is a stationary bladed wheel.

4. The method as claimed in claim 1 or 2, wherein the first wheel is a moving bladed wheel and the second bladed wheel is a stationary wheel, the moving bladed wheel being in a wake of the stationary bladed wheel.

5. The method as claimed in claim 1 or 2, wherein the first bladed wheel is a moving wheel and the second bladed wheel is a stationary wheel, the moving wheel being upstream of the stationary wheel.

6. The method as claimed in claim 1 or 2, wherein the first bladed wheel is a stationary wheel and the second bladed wheel is a moving wheel, the stationary wheel being in a wake of the moving wheel.

7. The method as claimed in claim 1 or 2, wherein the first bladed wheel is a stationary wheel and the second bladed wheel is a moving wheel, the stationary wheel being upstream of the moving wheel.

* * * * *

UNITED STATES PATENT AND TRADEMARK OFFICE

CERTIFICATE OF CORRECTION

PATENT NO. : 8,286,347 B2
APPLICATION NO. : 12/035966
DATED : October 16, 2012
INVENTOR(S) : Jerome Alain Dupeux et al.

It is certified that error appears in the above-identified patent and that said Letters Patent is hereby corrected as shown below:

Col. 8, line 4, Claim 2, change "$^{T}y_{yv}$" to --$^{T}y_{v}$--; and

Col. 8, line 11, Claim 2, change "f cos(ωt+φ)" to --fcos(ωt+φ)--.

Signed and Sealed this
Twenty-second Day of January, 2013

David J. Kappos

David J. Kappos
*Director of the United States Patent and Trademark Office*